US005341734A

United States Patent [19]

Jeschke et al.

[11] Patent Number: 5,341,734

[45] Date of Patent: Aug. 30, 1994

[54] METHOD AND DEVICE FOR REGULATING A SUPPLY OF DAMPENING SOLUTION IN AN OFFSET PRINTING PRESS

[75] Inventors: Willi Jeschke, Bad Herrenalb; Norbert Freyer, Sandhausen, both of Fed. Rep. of Germany

[73] Assignee: Heidelberger Druckmaschinen AG, Heidelberg, Fed. Rep. of Germany

[21] Appl. No.: 54,884

[22] Filed: Apr. 29, 1993

[30] Foreign Application Priority Data

Apr. 29, 1992 [DE] Fed. Rep. of Germany ..... 4214139

[51] Int. Cl.[5] ..... B41F 7/24; B41F 25/00

[52] U.S. Cl. ..... 101/148; 101/450.1

[58] Field of Search ..... 101/148, 147, 349, 350, 101/364, 207–210, DIG. 45, 483, 484, 450.1; 356/436; 427/10

[56] References Cited

U.S. PATENT DOCUMENTS 3,916,789 11/1975 Watts ..... 101/148
4,480,542 11/1984 Jeschke ..... 101/148
4,485,737 12/1984 Jeschke ..... 101/148
5,050,994 9/1991 Kipphan et al. ..... 101/147 X

FOREIGN PATENT DOCUMENTS 3247761 6/1984 Fed. Rep. of Germany .
3830732 3/1990 Fed. Rep. of Germany .

*Primary Examiner*—J. Reed Fisher
*Attorney, Agent, or Firm*—Herbert L. Lerner; Laurence A. Greenberg

[57] ABSTRACT

Method for regulating a supply of dampening solution in an offset printing press having a printing plate includes supplying at least one selected region of the printing plate with a well-defined amount of energy; determining and measuring scumming occurring in the selected region; comparing the measured scumming in the selected region with a prescribed scumming matched to the respective supplied amount of energy; and adjusting the supply of dampening solution, if the measured scumming and the prescribed scumming deviate from one another; and a device for performing the method.

18 Claims, 3 Drawing Sheets

METHOD AND DEVICE FOR REGULATING A SUPPLY OF DAMPENING SOLUTION IN AN OFFSET PRINTING PRESS

The invention relates to a method and a device for regulating a supply of dampening solution in an offset printing press.

The quality of printed products produced in an offset printing press depends essentially upon ink feed or inking and upon dampening-solution supply, which is adjusted to the inking. These variables, in turn, are dependent upon further parameters, such as temperature, ink composition, type of printing plate, grade of paper used, and so forth. While the inking decisively determines the color effect of a printed product, it is possible to influence contrast sharpness of the printed image by a correct supply of dampening solution.

Print quality is optimal when the dampening-solution supply is set so that the printing process takes place in the vicinity of a so-called smearing limit. The printed image is distinguished by high contrast sharpness and brilliance thereat.

Printing in the vicinity of the smearing limit is critical in that, if conditions should cause a drop below this limit, the non-printing regions of the printing plate begin to scum, i.e., ink deposits occur in the non-printing regions of the printing plate. If there is an excessive supply of dampening solution, as mentioned hereinbefore, the brilliance of the printed image is lost. In extreme cases, water marks occur in the printing regions which, like the aforedescribed scumming, results in the printing of rejected or waste sheets.

In heretofore known proposals for regulating dampening solution, "indirect" or "direct" measuring methods are used. Thus, German Patent 38 30 732 describes an "indirect" method for monitoring the supplying or feeding of dampening solution in an offset printing press. According to this heretofore known method, non-printing or subject-related ink-free areas and printing areas or subject-related areas covered with ink in the vicinity of an edge of a full-tone patch or patch are scanned by means of an opto-electric transducer. The resulting scanned signals are compared with setpoint or desired values. If there is a deviation between the scanned or measured values and the setpoint or desired values, necessary changes in the supply of dampening solution are determined in regard to the differences in the printing and non-printing area or surface coverages.

The foregoing, heretofore known indirect method, has an advantage over heretofore known direct measuring methods which determine the amount or quantity of dampening solution directly, in that the printed product itself is used in order to evaluate the supply of dampening solution: necessary adjustments to the supply of dampening solution are evaluated on the basis of the printing results, i.e., the printed product, and are thus largely independent of further parameters. This heretofore known indirect method, however, is problematic during the setting-up phase of the printing press.

It is accordingly an object of the invention to provide a method and a device for regulating the supply of dampening solution in an offset printing press which afford the possibility, even as early as during the setting-up phase, to effect a reliable setting or adjustment of the dampening-solution supply.

With the foregoing and other objects in view there is provided, in accordance with the invention, a method for regulating a supply of dampening solution in an offset printing press having a printing plate, which comprises supplying at least one selected region of the printing plate with a well-defined amount of energy; determining and measuring scumming occurring in the selected region; comparing the measured scumming in the selected region with a prescribed scumming matched to the respective supplied amount of energy; and adjusting the supply of dampening solution, if the measured scumming and the prescribed scumming deviate from one another.

In accordance with another aspect of the invention, there is provided a device for regulating a supply of dampening solution in an offset printing press having at least one printing plate, comprising at least one energy source for the one printing plate for supplying at least one selected region of the one printing plate with a well-defined amount of energy; measuring means for determining and measuring scumming occurring in the one selected region; evaluation means for comparing the measured scumming in the one selected region with a given scumming value matched to the well-defined amount of energy; and adjusting means for correcting the supply of the well-defined amount of energy in accordance with any deviation between the measured scumming and the given scumming value determined by the evaluation means.

In accordance with alternative features of the invention, the one energy source is a laser, a microwave transmitter, a heat source, or a compressed-air source. In general, virtually all energy sources which permit the production of a well defined quantity of energy: such as lasers, microwave transmitters, heat sources, compressed-air sources, and the like, may form part of the inventive device.

In accordance with another feature of the invention, the one selected region contains an oleophobic region of the one printing plate.

In accordance with a further feature of the invention, the one printing plate has a full-tone patch thereon, and the oleophobic region is disposed in vicinity of an edge of the full-tone field or patch. The oleophobic region is situated in the vicinity of an edge of the fulltone field or patch on the printing plate, because, experience has shown that scumming tends to occur first in such regions.

In accordance with an added feature of the invention, the one selected region is a half-tone field or patch. Likewise, it is also possible, however, to employ a specially formed half-tone field or patch, such as a line-screen field or patch, as the one selected region. Corrections in or adjustments to the supply of dampening solution are made when changes with regard to the scumming of the line-screen field or patch exceed or fall below a given or prescribed level which is matched to the well-defined amount of energy supplied.

In accordance with an additional feature of the invention, the one selected region is disposed on a nonprinting margin of the one printing plate. In this regard, it is noted that the non-printing or print-free margin of the one printing plate whereon the one selected region is disposed comes into contact with the dampening-solution applicator rollers and inking rollers. Adjustments of the energy source and to the measuring means are thereby largely prevented. As a reference for determining the area or surface coverage, for example, a full-tone patch and a non-printing or ink-free patch can be measured in the same printing form, i.e., the one printing plate.

In accordance with yet another feature of the invention, the printing press includes an inking unit with a plurality of successively disposed inking rollers, and a dampening unit with a plurality of successively disposed dampening-solution applicator rollers, and the one energy source is disposed between a last dampening-solution applicator roller of the plurality thereof and a first inking roller of the plurality thereof.

In accordance with an alternate feature of the invention, the printing press includes a dampening unit with a plurality of successively disposed dampening-solution applicator rollers, and the one energy source is disposed before a first dampening-solution applicator roller of the plurality thereof.

In accordance with another alternate feature of the invention, the printing press includes an inking unit with a plurality of successively disposed inking rollers, and the one energy source is disposed after a last inking roller of the plurality thereof.

In accordance with yet a further feature of the invention, the measuring means for determining and measuring scumming occurring in the one selected region comprise means operatively associated with a sheet which has been printed from the one plate in the printing press for measuring scumming in a region of the sheet corresponding to the one selected region. Thus, the measuring means determine and measure the scumming of the one selected region off-line, i.e., the scumming of the one selected region is determined outside the printing press on a sheet which has been printed in the printing press. In accordance with an alternate embodiment, the scumming of the selected region is determinable on-line on the sheet.

In accordance with yet an added feature of the invention, the printing press has a plate cylinder whereon the one printing plate is mounted, and wherein the measuring means is operatively associated with the plate cylinder of the printing press for measuring scumming in the one selected region on the printing plate mounted on the plate cylinder.

In accordance with an alternate feature of the invention, the printing press has a blanket cylinder operatively engageable with the one printing plate, the measuring means being operatively associated with the blanket cylinder for determining and measuring scumming of the one selected region at a respective location on the blanket cylinder corresponding to the one selected region on the one printing plate. In this regard, it is noted that because the printed image, in offset printing, is transferred from the printing plate onto the blanket cylinder and, thereafter, in the printing gap between the blanket cylinder and the impression cylinder, onto a sheet, it is also possible to determine the scumming of the one selected region at a relevant location on the blanket cylinder which corresponds to the one selected region on the printing plate.

In accordance with yet an additional feature of the invention, at least one cross-piece is mounted in the device and carries at least one of the energy source and the measuring means at a respective suitable location with respect to a plate of a plate cylinder, for example, which is being scanned.being scanned. The energy source and/or the measuring means are movable on the respective cross-piece to the desired measuring positions via an automatic or manual control.

In accordance with a concomitant feature of the invention, means are provided for switching the energy source on and off, and the measuring means is actuatable for determining and measuring scumming of the one selected region in a scumming and in a non-scumming condition. This feature is applicable when the device according to the invention is intended for on-line regulation.

Alternatively, in the immediate vicinity of the one selected region wherein the dampening-solution supply is influenced by the supply of energy, an identical selected region which is not influenced by a controlled supply of energy may be used for measuring purposes. In order to determine the area or surface coverage, it is furthermore possible to measure a full-tone region and a nonprinting or ink-free region.

Other features which are considered as characteristic for the invention are set forth in the appended claims.

Although the invention is illustrated and described herein as embodied in a device and a method for regulating a dampening-solution supply in an offset printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
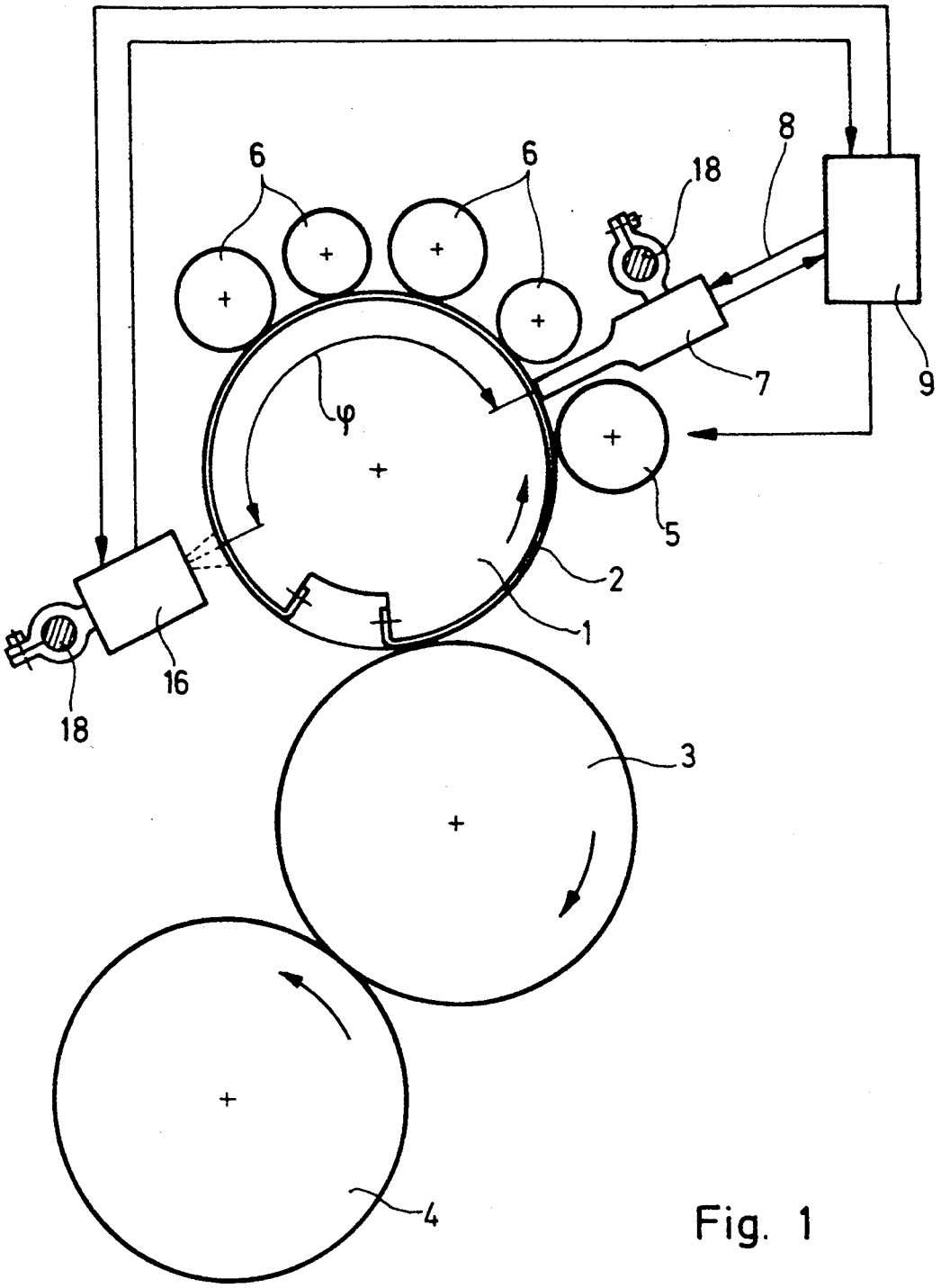
FIG. 1 is a diagrammatic side elevational view, psrtly schematic, of a printing unit incorporating a device for regulating a dampening-solution supply, in accordance with the invention.

Referring now to the drawing and, first, particularly to FIG. 1 thereof, there is shown therein a printing unit with the device according to the invention. The printing unit includes conventional printing-unit cylinders, namely a plate cylinder 1 carrying a printing plate 2, a blanket cylinder 3 and an impression cylinder 4, the cylinders being in mutual rolling engagement. Only a last dampening-solution applicator roller 5 of an otherwise non-illustrated conventional dampening unit is shown in the figure; likewise, a representation of a conventional inking unit in the figure has been restricted to inking rollers 6 thereof, all in the interest of clarity.

The device according to the invention includes an energy source 7, a measuring device 16 and an evaluation/control device 9. The energy source 7 transmits energy to a selected region 14 (FIG>3) of the printing plate 2. The selected region 14 of the printing plate 2 is, quite generally, a region of the plate containing nonprinting, i.e. oleophobic, locations. Both the energy source 7 as well as the measuring apparatus 16 may be displaced in axial direction of the plate cylinder 1 through the intermediary of traverses or cross-pieces 18.

Controlled by the evaluation/control device 9, the energy source 7 transmits a well defined quantity of energy to the selected region 14. Consequently, a small, precisely defined and always constant quantity of dampening solution is removed thereby from the selected region 14, so that a clearly visible scumming occurs in the region of the printed image. The evaluation/control device 9 regulates the supply of dampening solution so that, with a constant removal of dampening solution, the scumming in the selected region 14 reaches a given prescribed level during the setting-up phase and so that the given level is maintained during the production phase, respectively. With the device according to the invention, it is possible to adjust or set the supply of dampening solution for the printing process, more or less independently of other parameters such as type of plate, temperature, and so forth.

Figure 2:
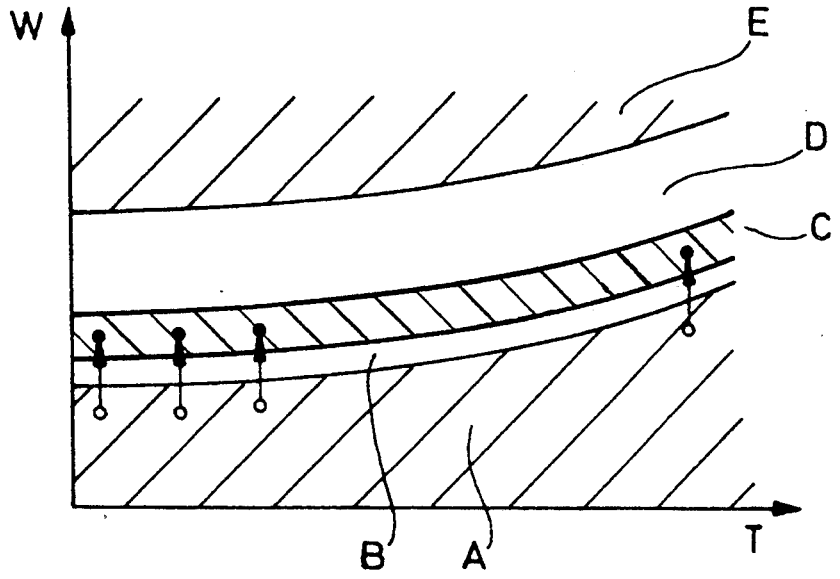
FIG. 2 is a plot diagram representing the supplied quantity of dampening solution as a function of temperature.

FIG. 2 is a graph showing the required quantity W of dampening solution as a function of temperature T. In zone A, the dampening-solution supply is so small that ink deposits occur in the non-printing regions of the printing plate 2; scumming is a result thereof and, consequently, the printing of waste sheets. Zones B, C, D represent the working zone. In order to obtain a good printed product, the dampening-solution quantity must be set in this working zone B, C, D. The narrow zone B between the zones A and C forms the so-called smearing limit, i.e., the limit at which the non-printing regions start to accept ink.

As mentioned hereinbefore, print quality in the vicinity of the smearing limit is optimal. Consequently, the printer will endeavor to maintain the dampening-solution quantity within the optimal working zone C.

In zone E, the supply of dampening solution is so great that water marks appear in the printing regions and, just as the scumming, leads to the printing of waste sheets.

As shown in the plot diagram of FIG. 2, an effect of an increase in temperature, when the inking is constant, is that the supply of dampening solution has to be increased in order to ensure that the printing process will continue to take place within the optimal working zone. With the device according to the invention, which uses as a controlled variable the controlled scumming of a selected region of the printing plate 2, the regulation of the dampening solution is more-or-less independent of all disruptive influences.

Figure 3:
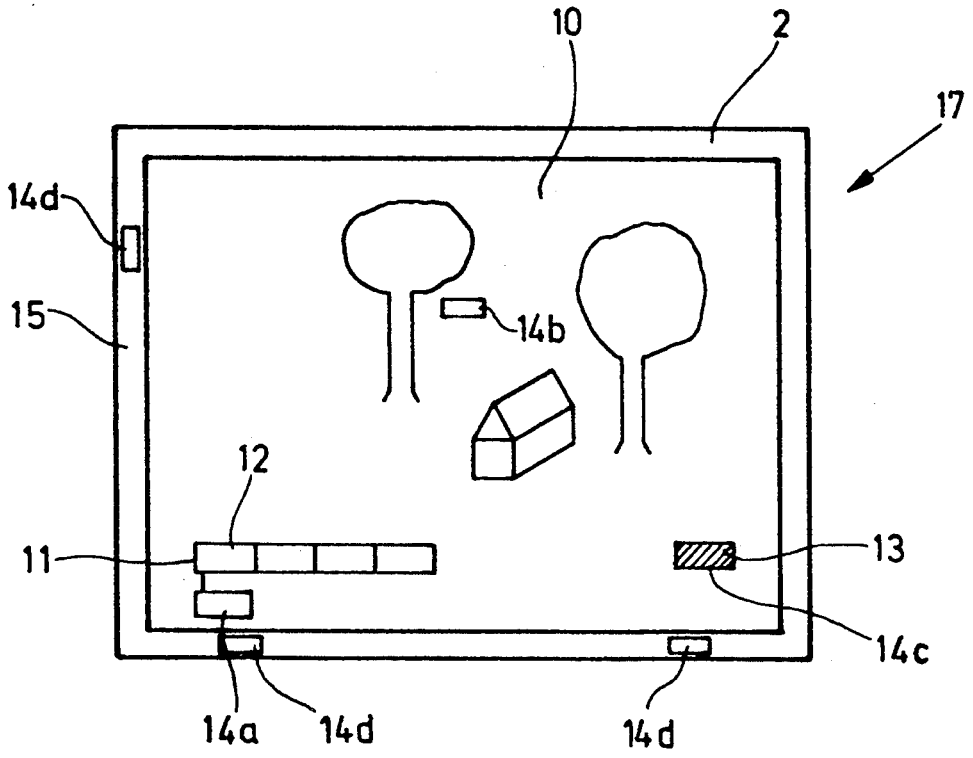
FIG. 3 is a fanciful representation of a printed product with selected inked and non-inked regions.

FIG. 3 is a fanciful diagrammatic representation of a printing plate 2 bearing an image or subject 10. According to possible embodiments of the device according to the invention, the selected region 14*a* is disposed in the vicinity of a full-tone patch 12 of a quality-control strip 11, or the selected region 14*b* is disposed in the vicinity of a region with high area coverage in the subject 10. Alternative embodiments provide for a selected region 14*c* to be a halftone patch, for example a line-screen patch, separately printed in the same form, or for a selected region 14*d* to be situated in the region of the non-printing or print-free border 15 of the printing plate 2.

Figure 4:
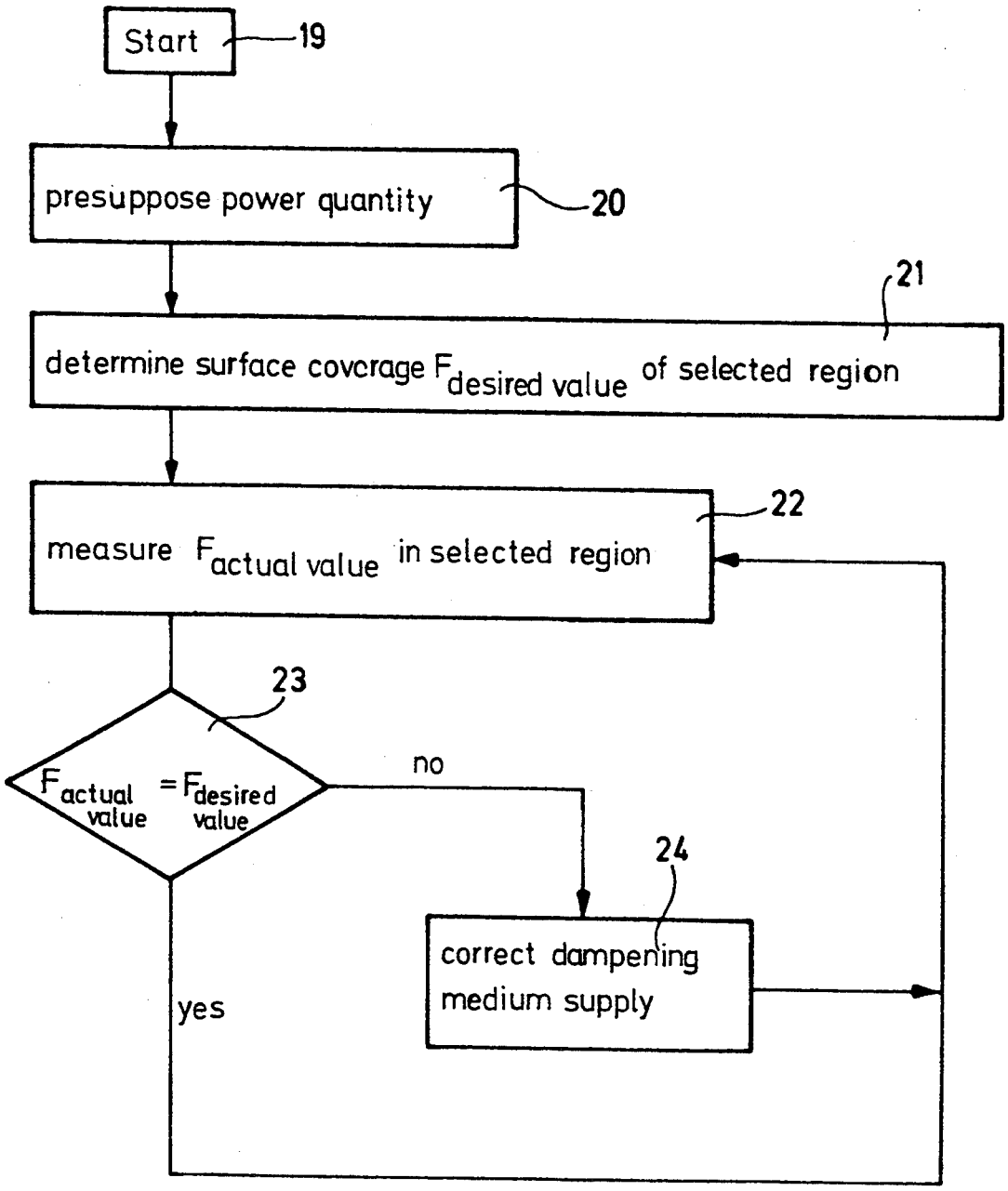
FIG. 4 is a flow chart for controlling the device for regulating the supply of dampening solution in accordance with the invention.

FIG. 4 is a flow diagram for controlling the device according to the invention for regulating a supply of dampening solution in an offset printing press. The program is started at 19. At 20, the evaluation/control device 9 of the energy source 7 specifies an amount or quantity of energy which is to be supplied to the printing plate 2, the amount of energy depending, among other things, on the rotational speed of the printing press. At point 21 in the flow diagram, the area or surface coverage $F_{desired\ value}$ or $F_{setpoint}$ of a selected region 14 of the printing plate 2 is determined as a function of the amount or quantity of energy supplied to the selected region 14, the area or surface coverage $F_{desired\ value}$ being the area or surface coverage which should occur as a result of the intentionally produced, controlled scumming for a given dampening-solution supply.

Thereafter, at 22, the measuring device 16 is triggered so that, allowing for the angular offset between the energy source 7 and the measuring device 16 and taking into account the rotational speed of the printing press, the measuring device 16 determines the area or surface coverage $F_{actual\ value}$ in the selected region 14. At 23, the measured area or surface coverage $F_{actual\ value}$ is compared with the given area or surface coverage in the selected region 14. If there is a deviation between the area or surface coverages $F_{actual\ value}$ and $F_{desired\ value}$, the evaluation/control device 9 initiates at 24 a suitable adjustment for correcting the supply of dampening solution.

The determination of the area or surface coverage represents one possible way of determining the scumming. For this purpose, it is necessary to print and to measure reference patches with area or surface coverages of 0% and 100%. Of course, it is also possible to compare the measured values directly with prescribed or given values.

We claim:

1. Method for regulating a supply of dampening solution in an offset printing press having a printing plate, which comprises supplying at least one selected region of the printing plate with a well-defined amount of energy for removing a constant quantity of dampening solution from the selected region; determining and measuring scumming occurring in the selected region; comparing the measured scumming in the selected region with a prescribed scumming matched to the respective supplied amount of energy; and adjusting the supply of dampening solution, if the measured scumming and the prescribed scumming deviate from one another.

2. Device for regulating a supply of dampening solution in an offset printing press having at least one printing plate, comprising at least one energy source for the one printing plate for supplying at least one selected region of the one printing plate with a well-defined amount of energy for removing a constant quantity of dampening solution from the selected region; measuring means for determining and measuring scumming occurring in said one selected region; evaluation means for comparing the measured scumming in said one selected region with a given scumming value matched to said well-defined amount of energy; and adjusting means for correcting said supply of said well-defined amount of energy in accordance with any deviation between said measured scumming and said given scumming value determined by said evaluation means.

3. Device according to claim 2, wherein said one energy source is a laser.

4. Device according to claim 2, wherein said one energy source is a microwave transmitter.

5. Device according to claim 2, wherein said one energy source is a heat source.

6. Device according to claim 2, wherein said one energy source is a compressed-air source.

7. Device according to claim 2, wherein said one selected region contains an oleophobic region of the one printing plate.

8. Device according to claim 7, wherein the one printing plate has a full-tone patch thereon, and said oleophobic region is disposed in vicinity of an edge of said full-tone patch.

9. Device according to claim 2, wherein said one selected region is a half-tone patch.

10. Device according to claim 2, wherein said one selected region is disposed on a nonprinting margin of the one printing plate.

11. Device according to claim 2, wherein the printing press includes an inking unit with a plurality of successively disposed inking rollers, and a dampening unit with a plurality of successively disposed dampening-solution applicator rollers, and said one energy source is disposed between a last dampening-solution applicator roller of said plurality thereof and a first inking roller of said plurality thereof.

12. Device according to claim 2, wherein the printing press includes a dampening unit with a plurality of successively disposed dampening-solution applicator rollers, and said one energy source is disposed before a first dampening-solution applicator roller of said plurality thereof.

13. Device according to claim 2, wherein the printing press includes an inking unit with a plurality of successively disposed inking rollers, and said one energy source is disposed after a last inking roller of said plurality thereof.

14. Device according to claim 2, wherein said measuring means for determining and measuring scumming occurring in said one selected region comprise means operatively associated with a sheet which has been printed from the one plate in the printing press for measuring scumming in a region of the sheet corresponding to said one selected region.

15. Device according to claim 2, wherein the printing press has a plate cylinder whereon the one printing plate is mounted, and wherein said measuring means is operatively associated with the plate cylinder of the printing press for measuring scumming in said one selected region on the printing plate mounted on the plate cylinder.

16. Device according to claim 2, wherein the printing press has a blanket cylinder operatively engageable with the one printing plate, said measuring means being operatively associated with said blanket cylinder for determining and measuring scumming of said one selected region at a respective location on said blanket cylinder corresponding to said one selected region on the one printing plate.

17. Device according to claim 2, including at least one cross-piece mounted in the device and carrying at least one of said energy source and said measuring means.

18. Device according to claim 2, including means for switching said energy source on and off, and said measuring means being actuatable for determining and measuring scumming of said one selected region in a scumming and in a non-scumming condition.

* * * * *